United States Patent [19]

Balwigaire

[11] Patent Number: 5,052,970

[45] Date of Patent: Oct. 1, 1991

[54] GRAVITATIONALLY MOTIVATED TOY APPARATUS

[76] Inventor: John D. Balwigaire, 108 E. Ave., San Gabriel #1, San Clemente, Calif. 92672

[21] Appl. No.: 559,678

[22] Filed: Jul. 23, 1990

[51] Int. Cl.[5] ..... A63H 13/00

[52] U.S. Cl. ..... 446/351; 446/322; 446/365; 446/367

[58] Field of Search ..... 446/316, 228, 351, 322, 446/396, 330, 359, 365, 367, 353, 360, 304

[56] References Cited

U.S. PATENT DOCUMENTS

| | | | |
|---|---|---|---|
| 1,569,637 | 1/1926 | Snyder | 446/365 |
| 1,782,042 | 2/1929 | Kunkel | 446/365 |

FOREIGN PATENT DOCUMENTS

| | | | |
|---|---|---|---|
| 313316 | 7/1919 | Fed. Rep. of Germany | 446/351 |
| 537646 | 3/1922 | France | 446/304 |
| 36948 | 5/1922 | Norway | 446/351 |

*Primary Examiner*—Robert A. Hafer
*Assistant Examiner*—David J. Kenealy
*Attorney, Agent, or Firm*—Leon Gilden

[57] ABSTRACT

A toy apparatus includes a simulated bird like figure, including a main body portion and legs mounted to underlying platform, with a head member and a tail member pivotally mounted at respective forward and rear terminal ends of the body member. Pendulum lines are mounted to the head member and to the tail member to effect oscillation of the figure upon oscillation of an associated pendulum weight mounted to lower ends of the pendulum lines.

2 Claims, 4 Drawing Sheets

PRIOR ART

GRAVITATIONALLY MOTIVATED TOY APPARATUS

BACKGROUND OF THE INVENTION

1. Field of the Invention

The field of the invention relates to toy apparatus, and further pertains to a new and improved gravitationally motivated toy apparatus wherein the same sets forth a gravitationally motivated bird like member simulating a bird feeding from a predetermined quantity of food positioned forwardly thereof.

2. Description of the Prior Art

Various toy apparatus and toy apparatus utilizing gravity as motivating force are set forth in the prior art for amusement, entertainment, and education of individuals. The instant invention sets forth a toy and further a toy that may be utilized in a game format to direct a bird like figure utilizing gravity as the motivating force to pivot in an oscillating manner, a beak portion of the bird like figure into a forwardly oriented food container.

Prior art structure for gravitational type toys may be found in U.S. Pat. RE. No. 13,696 to MAHAN wherein a toy like member is directed downwardly along a platform with leg portions pivotally mounted interiorly of the body portion of the figure and obliquely oriented balancing weights positioned laterally of the figure.

U.S. Pat. No. 2,861,390 to MARTIN sets forth a gravity motivated figure where the figure includes a central rod including a lower-most tip that further includes a weight at a lower-most end of the figure with the tip projecting therethrough with the weight offset relative to the figure to effect a wobbling motion of the figure along a tilted ramp.

U.S. Pat. No. 4,687,460 to KATZMARZIK sets forth a gravitationally motivated toy wherein a central body portion includes spaced parallel plate members with a simulated bird leg member pivotally mounted through the plates to simulate a "walking" of the figure down an incline platform.

U.S. Pat. No. 2,140,275 to WALSON sets forth a walking toy utilizing pivotally mounted legs directed through a generally cylindrical body cavity.

U.S. Pat. No. 2,618,895 to SIDNEY sets forth a gravity type toy wherein a body member includes arm portions pivot upwardly thereof for securement to an overlying platform where the arm members are alternately pivoted relative to the body to effect a movement of the body downwardly along the platform.

As such, it may be appreciated that there continues to be a need for a new and improved gravitationally motivated toy apparatus wherein the same addresses both the issues of ease of use as well as effectiveness in construction in setting forth a gravitationally simulated toy utilized for entertainment, education, and for cumulative use as a game organization.

SUMMARY OF THE INVENTION

In view of the foregoing disadvantages inherent in the known types of gravitationally motivated toys present in the prior art, the present invention provides a new and improved gravitationally motivated toy apparatus wherein the same utilizes a longitudinally aligned bird like figure with a rear and forward portion pivotally mounted to the body to simulate the bird like figure a feeding mode. As such, the general purpose of the present invention, which will be described subsequently in greater detail, is to provide a new and improved gravitationally motivated toy apparatus which has all the advantages of the prior art gravitationally motivated toys and none of the disadvantages.

To attain this, the gravitationally motivated toy apparatus of the invention includes a toy apparatus includes a simulated bird like figure including a main body portion and legs mounted to underlying platform with a head member and a tail member pivotally mounted at respective forward and rear terminal ends of the body member. A first pendulum line is mounted to the head member and a second pendulum line is mounted to the tail member wherein the lines are directed through the platform and slots formed in the platform and joined at an intersection below the platform with a third pendulum line mounting a pendulum weight at a lower terminal end thereof. The apparatus further includes a container longitudinally aligned with the head, body, and tail portions of the bird like figure with a predetermined quantity of pierceable simulated segments positioned therewithin. During pendulum oscillation of the pendulum weight, the head and tail sections alternate pivotment relative to the body with the head including a forwardly extending beak projecting into the container wherein optional aspect of the invention permits the beak to selectively pierce the segments and extract a segment from the container for use by opposing players.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gravitationally motivated toy apparatus which has all the advantages of the prior art gravitationally motivated toy apparatus and none of the disadvantages.

It is another object of the present invention to provide a new and improved gravitationally motivated toy apparatus which may be easily and efficiently manufactured and marketed.

It is a further object of the present invention to provide a new and improved gravitationally motivated toy apparatus which is of a durable and reliable construction.

An even further object of the present invention is to provide a new and improved gravitationally motivated toy apparatus which is susceptible of a low cost of manufacture with regard to both materials and labor, and which accordingly is then susceptible of low prices of sale to the consuming public, thereby making such gravitationally motivated toy apparatus economically available to the buying public.

Still yet another object of the present invention is to provide a new and improved gravitationally motivated toy apparatus which provides in the apparatuses and methods of the prior art some of the advantages thereof, while simultaneously overcoming some of the disadvantages normally associated therewith.

Still another object of the present invention is to provide a new and improved gravitationally motivated toy apparatus which may be compactly stored when not being utilized.

Yet another object of the present invention is to provide a new and improved gravitationally motivated toy apparatus wherein the same sets forth a simulated bird like figure to recreate a feeding disposition of the figure and further for its utilization of the organization as a game apparatus.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
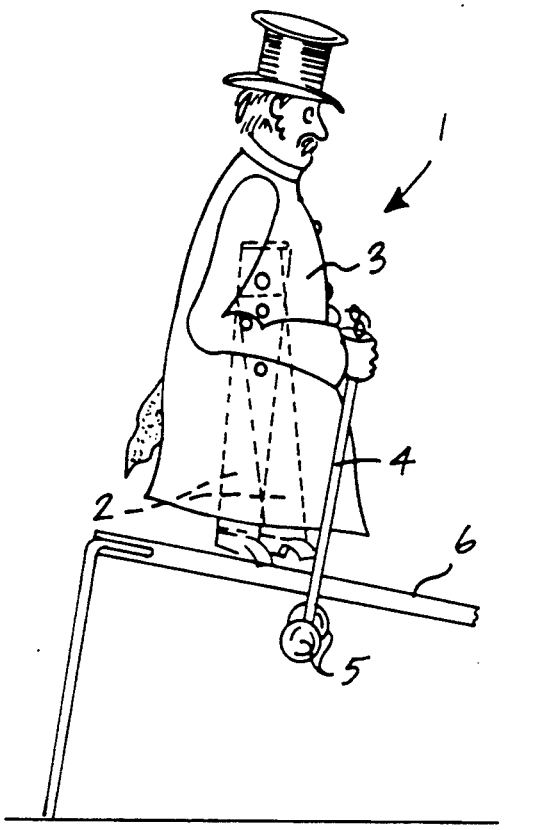
FIG. 1 is an orthographic side view of a prior art gravitationally motivated toy.
Figure 2:
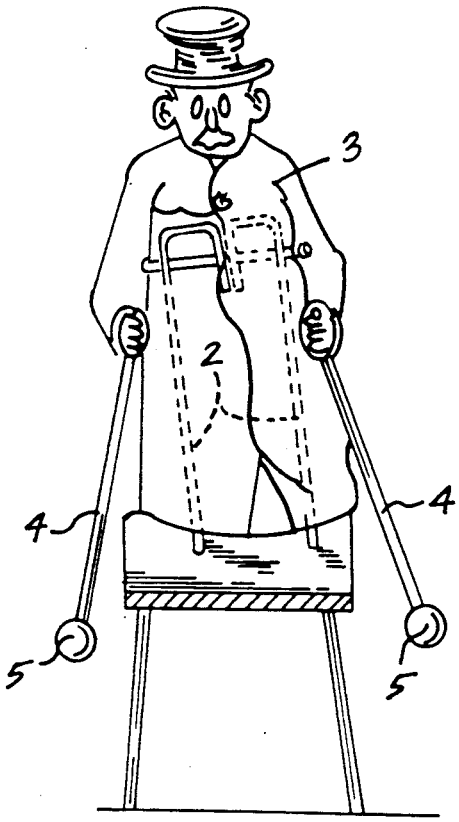
PRIOR ART FIG 2
FIG. 2 is an orthographic frontal view taken in elevation of the gravitationally motivated toy as set forth in FIG. 1.

With reference now to the drawings, and in particular to FIGS. 1 to 10 thereof, a new and improved gravitationally motivated toy apparatus embodying the principles and concepts of the present invention and generally designated by the reference numeral 10 will be described.

FIG. 1 illustrates a prior art gravitationally motivated toy apparatus 1 wherein a body member 3 includes a hollow cavity therewithin to mount a plurality of leg members 2 pivotally contained within the body wherein ballast post 4 are directed obliquely and laterally of the body including ballast weights 5 at lower-most ends thereof to balance the organization during its traverse downwardly along a platform 6.

More specifically, the gravitationally motivated toy apparatus 10 of the instant invention essentially comprises a horizontally disposed platform 11 defining a platform cavity 12 thereunder wherein the platform 11 is spaced above a support surface by downwardly depending side portions to define the cavity 12 between the side portions as illustrated to effect a spacing of the platform above the support surface.

Figure 4:
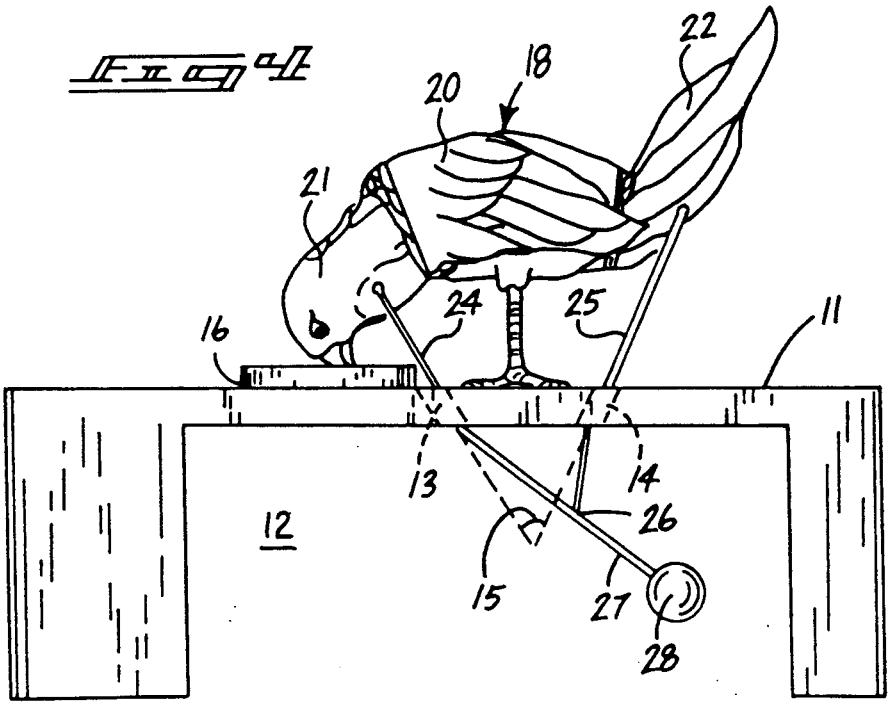
FIG. 4 is an orthographic side view of the instant invention in a first position.

The platform 11 includes a forward slot 13 longitudinally aligned with a rear slot 14 with the forward and rear slot directed through the platform and at oblique angle relative to the platform to define an included acute angle 15 that is defined by intersecting center line projections of each of the respective rear and forward slots with the included angle 15 spaced above an underlying support surface relative to the platform and below the platform 11 in a manner as illustrated in FIG. 4. A container 16 is positioned forwardly and aligned longitudinally with the rear and forward slots 14 and 13 respectively and includes a quantity of simulated food segments 17. The segments 17 may be formed of a pierceable material such as styrofoam and the like. A longitudinally aligned simulation FIG. 18 is positioned medially and longitudinally aligned with the forward and rear slots 13 and 14. The figure includes a central body member 20 positioned between the rear and forward slots and includes a plurality of support legs 19 oriented orthogonally relative to the platform 11 and fixedly mounted thereto as well as to the horizontally disposed body member 20. The body member 20 includes a head member 21 pivotally mounted at a forward end thereof and a tail member pivotally mounted at a rear end thereof.

The head member 21 includes a piercing beak projection 23 terminating in a forwardly oriented tip 23*a*. A first flexible pendulum line 24 is mounted to the body member 20 with a second flexible pendulum line 25 mounted to the tail member 22 wherein the first and second flexible lines are respectively directed through the forward and rear slots 13 and 14 and joined below the platform 11 at a line intersection 26. A third flexible pendulum line 27 is secured to the line intersection 26 and includes a spherical pendulum weight 28 mounted at a lower-most terminal end of the third pendulum line 27.

Figure 6:
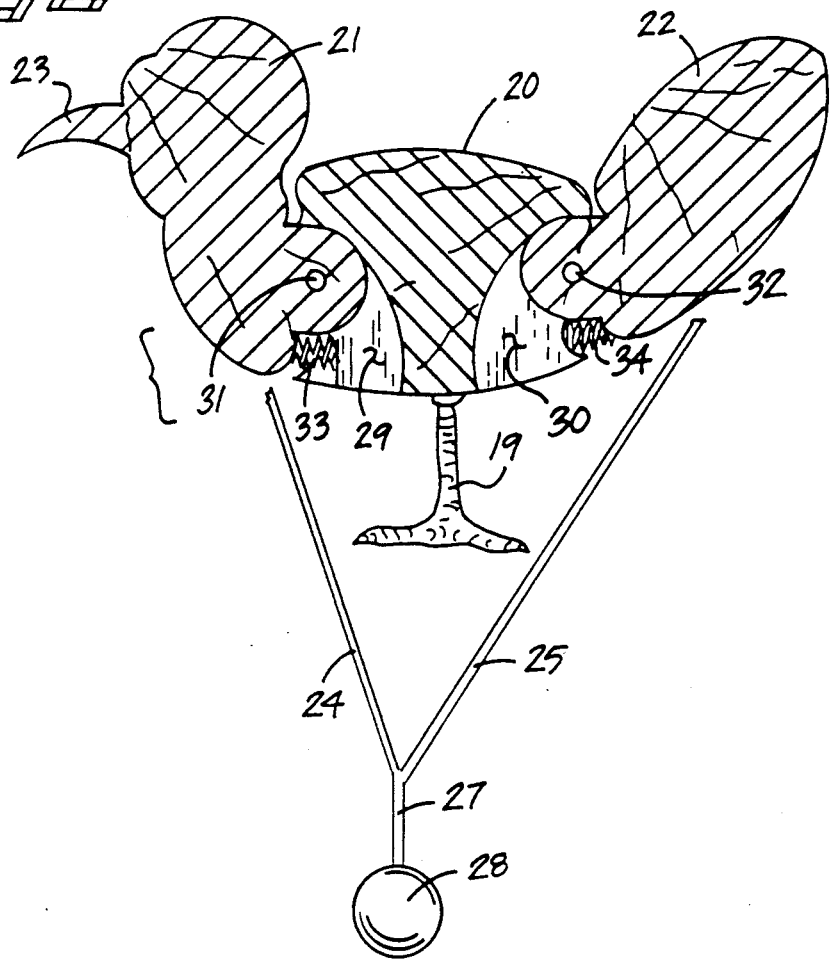
FIG. 6 is an orthographic cross-sectional view of the figure organization of the instant invention.
Figure 7:
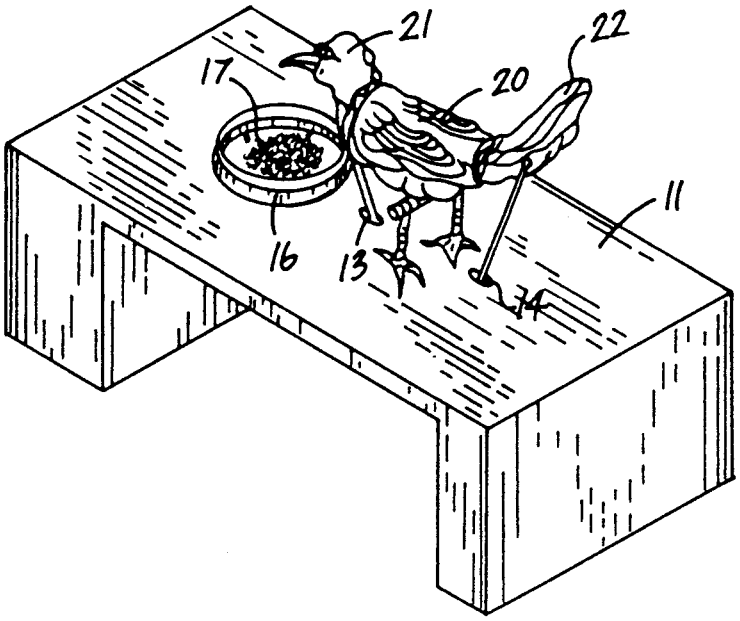
FIG. 7 is an isometric illustration of the instant invention in the first position.
Figure 8:
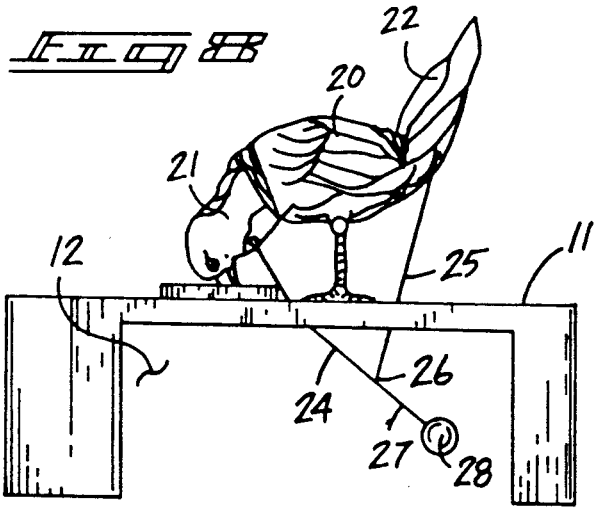
FIG. 8 is an further orthographic side view of the figure of the instant invention in the second position.

The head member 21 is mounted within a forward body cavity 29 by a forward pivot axle 31 that is arranged generally parallel to the platform 11 and wherein a rear body cavity 30 pivotally mounts the tail member 22 therewithin by a rear pivot axle 32 that is arranged parallel to the forward pivot axle 31 as well as the platform 11. A forward spring member 33 mounted between the head member 21 and the body member 20 within the forward body cavity 29 and below the forward pivot axle 31 biases the head member 21 in a raised orientation. A rear spring member 34 mounted within the rear body cavity 30 underlying the rear pivot axle 32 biases the tail member 22 in a raised orientation in a manner as illustrated in FIG. 6.

Figure 3:
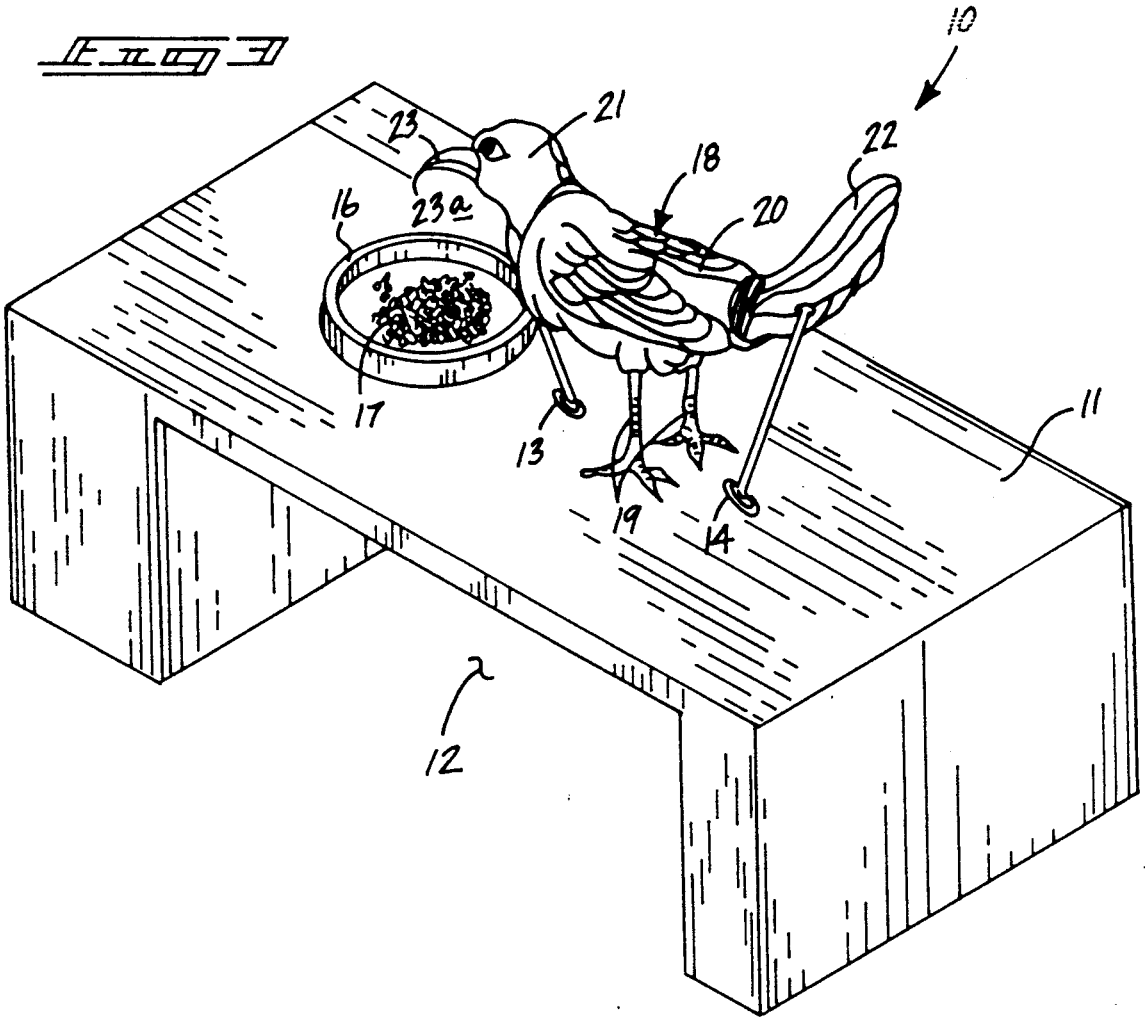
FIG. 3 is an isometric illustration of the instant invention.
Figure 5:
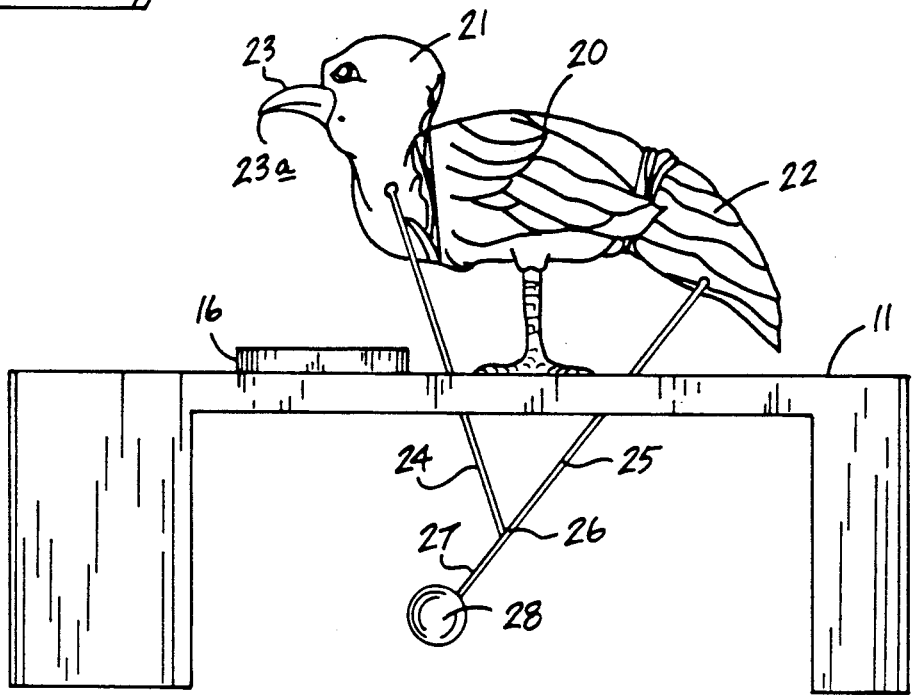
FIG. 5 is an orthographic side view of the instant invention in a second position.

FIG. 3 illustrates the organization in a first position whereupon swinging of the pendulum plate 28 directs the head member 21 in a downwardly orientation and projects the tip 23*a* of the beak projection 23 within the container 16 when the pendulum 28 is in the second position underlying the tail member 22. The pendulum weight 28 swung to a third position underlying the head member 21 as illustrated in FIG. 5 releases tension from the first flexible line 24 while tensioning the second flexible line 25 and directs the tail member 22 in a downward position of the second position of the FIG. 18. The first position is illustrated in FIG. 6 FIG. 18 and the head and tail members 21 and 22 in raised orientations. It is understood that momentum of the pendulum weight effects projection downwardly of the head and tail members 21 and 22 during use.

Figure 9:
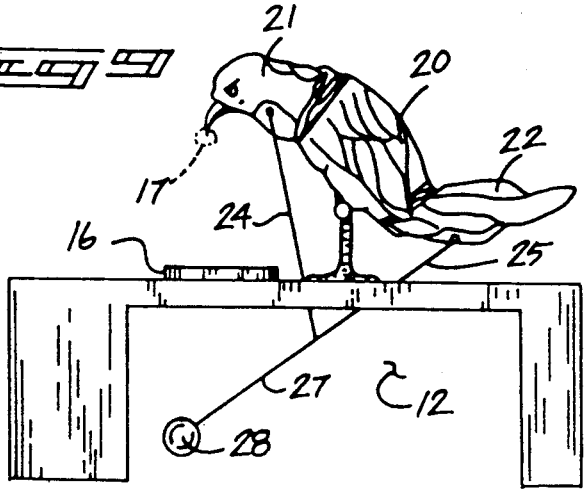
FIG. 9 is a further orthographic side view of the instant invention in the third position in use as a game apparatus to secure a food segment from the associated container.

Further, plurality of participants may effect a game scenario from the organization by utilizing the pierceable food segments 17 whereupon opponents may take turns and compete for a player to secure a greatest number of segments 17 onto the tip 23*a* in a manner as illustrated in FIG. 9.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A gravitationally motivated toy apparatus comprising, a horizontally disposed platform, the platform including a forward slot and a rear slot projecting through the platform, the forward slot and the rear slot are directed through the platform at an oblique angle relative to the platform where projection of the forward and rear slots intersect below the platform at an acute included angle therebetween, and the platform includes spaced supports to position the platform to define a platform cavity between the supports where a projection of the forward and rear slots define the included angle oriented within the cavity, and a simulation figure positioned in alignment with the forward and rear slots and medially thereof where the simulation figure includes a body member fixedly mounted relative to the platform and a head member pivotally mounted relative to the body member forwardly of the body member, and a tail member pivotally mounted to the body member rearwardly of the body member, and the simulation figure is arranged in a first position, wherein the motivation means is operative to effect pivotment of the head member relative to the body member in a first position and pivotment of the tail member relative to the body member in a second position, and including a container arranged forwardly of the forward slot and in longitudinal alignment with the forward slot, the rear slot and the simulation figure, and the container fixedly mounted to the platform, and the container including a plurality of food simulation segments therewithin, and wherein the motivation means includes a first flexible line mounted to the head member projecting to the forward slot and terminating at a line intersection below the platform, and a second pendulum line mounted to the tail member directed through the rear slot and secured to the first line at the line intersection, and a third flexible line mounted to the first and second line at the line intersection, and a pendulum weight mounted to a lowermost terminal end of the third line wherein the pendulum weight is positioned within the cavity and above lowermost terminal ends of the supports of the platform, and wherein the body member includes a plurality of leg members, the leg members fixedly mounted to the body member, and the body member horizontally aligned overlying the platform and the leg members orthogonally and fixedly mounted to the platform medially of the forward and rear slots, and wherein the body member includes a forward cavity and a rear cavity, wherein the head member is pivotally mounted within the forward cavity and the tail member is pivotally mounted within the rear cavity, and wherein the head member includes a forward axle mounted to the body member within the forward cavity and includes a forward spring underlying the forward axle cooperatively mounted between the head member and the body member to bias the head member in a raised position.

2. Apparatus as set forth in claim 1 wherein the tail member includes a rear axle mounted within rear cavity wherein the rear axle is arranged parallel to the forward axle and the forward and rear axles are arranged parallel relative to the platform, and a spring means underlying the rear axle cooperatively mounted between the tail member and the body member within the rear cavity to bias the tail member in a raised position.

* * * * *